US006179053B1

(12) United States Patent
Dallas

(10) Patent No.: US 6,179,053 B1
(45) Date of Patent: Jan. 30, 2001

(54) LOCKDOWN MECHANISM FOR WELL TOOLS REQUIRING FIXED-POINT PACKOFF

(76) Inventor: L. Murray Dallas, 790 River Oaks Dr., Fairview, TX (US) 75069

( * ) Notice: Under 35 U.S.C. 154(b), the term of this patent shall be extended for 0 days.

(21) Appl. No.: 09/373,418

(22) Filed: Aug. 12, 1999

(51) Int. Cl.[7] ..... E21B 23/03
(52) U.S. Cl. ..... 166/77.51; 166/341; 166/382
(58) Field of Search ..... 166/77.51, 348, 166/341, 338, 351, 381, 383, 382

(56) References Cited

U.S. PATENT DOCUMENTS

| | | | | |
|---|---|---|---|---|
| 3,924,678 | * | 12/1975 | Ashlstone | 166/120 |
| 4,241,786 | | 12/1980 | Bullen . | |
| 4,632,183 | | 12/1986 | McLeod . | |
| 4,867,243 | | 9/1989 | Garner et al. . | |
| 5,069,288 | * | 12/1991 | Singeetham | 166/348 |
| 5,080,174 | * | 1/1992 | Hynes | 166/382 |
| 5,145,006 | * | 9/1992 | June | 166/341 |
| 5,247,997 | * | 9/1993 | Puccio | 166/348 |
| 5,540,282 | * | 7/1996 | Dallas | 166/379 |
| 5,819,851 | | 10/1998 | Dallas . | |

* cited by examiner

*Primary Examiner*—Frank Tsay
(74) *Attorney, Agent, or Firm*—Dority & Manning, P.A.

(57) ABSTRACT

An apparatus for securing a mandrel of a well tool in an operative position in which the mandrel is packed off against a fixed-point in the well is described. The apparatus includes a mechanical lockdown mechanism to secure the tool to the wellhead and maintain the mandrel in proximity to the fixed-point for packoff, and a mechanical or a hydraulic mechanism to move the mandrel into the operative position while the mechanical lockdown mechanism is in a lockdown position. A second mechanical locking mechanism is provided to ensure the mandrel is maintained in the operative position in the event that hydraulic pressure is lost. The invention provides a mechanism to lock down well tools requiring fixed-point packoff in a well and advantageously improves the range of adjustment of the lockdown mechanism so that the length of a mandrel may be less precisely matched to a distance from a top of the wellhead to the fixed-point in the well.

27 Claims, 9 Drawing Sheets

LOCKDOWN MECHANISM FOR WELL TOOLS REQUIRING FIXED-POINT PACKOFF

TECHNICAL FIELD

The present invention relates to equipment for servicing oil and gas wells and, in particular, to an apparatus and method for securing a mandrel of a well tool in an operative position in which the mandrel is packed-off against a fixed-point in the well.

BACKGROUND OF THE INVENTION

Most oil and gas wells eventually require some form of stimulation to enhance hydrocarbon flow and make or keep them economically viable. The servicing of the oil and gas wells to stimulate production requires the pumping of fluids under high pressure. The fluids are generally corrosive and abrasive because they are frequently laden with corrosive acids and abrasive proppants such as sharp sand. Consequently, such fluids can cause irreparable damage to wellhead equipment if they are pumped directly through the spool and the various valves that make up the wellhead. To prevent such damage, wellhead isolation tools have been used and various configurations are well known in the art.

A general principle of wellhead isolation in the prior art is to insert a mandrel of the tools through the various valves and spools of the wellhead to isolate those components from the elevated pressures and the corrosive and abrasive fluids used in the well treatment to stimulate production. A top end of the mandrel is connected to one or more high pressure valves through which the stimulation fluids are pumped. A packoff assembly is usually provided at a bottom end of the mandrel for achieving a fluid seal against the inside of the production tubing or casing so that the wellhead is completely isolated from the stimulation fluids. The length of the mandrel need not be precise because the location of the packoff assembly in the production tubing or casing is immaterial so long as the mandrel is inserted into the production tubing or casing and a fluid tight seal is achieved between the production tubing or casing and the packoff assembly.

However, a packoff affixed to a bottom end of the mandrel which seals against the inside of the production tubing or casing, limits the internal diameter of the mandrel and, consequently, the flow rate at which stimulation fluids may be pumped into the well. To overcome this problem, applicant invented an improved mandrel for a wellhead isolation tool described in co-pending U.S. patent application Ser. No. 08/837,574 which was filed on Apr. 21, 1997 and entitled APPARATUS FOR INCREASING THE TRANSFER RATE OF PRODUCTION STIMULATION FLUIDS THROUGH THE WELLHEAD OF A HYDROCARBON WELL. The apparatus described in that patent application includes a mandrel for a wellhead isolation tool and a tubing hanger for use in conjunction with the mandrel. The mandrel includes an annular seal bonded to an outside wall above the bottom end of the mandrel. The annular seal cooperates with a sealing surface in the top end of the tubing hanger to isolate the wellhead equipment from high pressures and corrosive and abrasive materials pumped into the well during a well treatment to stimulate production. The novel construction of the mandrel and the tubing hanger eliminates the requirement for a packoff assembly attached to the bottom of the mandrel and thereby permits the mandrel to have a larger internal diameter for increasing the transfer rate of the production stimulation fluids through the wellhead. The axial length of the sealing surface in the tubing hanger available for packoff is limited and, therefore, the length of the mandrel is determined, to a large extent, by a distance from the top of the tubing hanger to the top of the wellhead.

Applicant describes another improved mandrel for a wellhead isolation tool in U.S. patent application Ser. No. 09/356,231 which was filed on Jul. 16, 1999 and entitled WELLHEAD ISOLATION TOOL AND METHOD OF USING SAME, which is incorporated herein by reference. The wellhead isolation tool includes a mandrel that is inserted into a wellhead. The mandrel is seated against an annular step above back pressure valve threads in a tubing hanger to isolate the pressure sensitive components of the wellhead from fluid pressure used in the well treatment and has a lower section extending past the back pressure valve threads and tubing threads into the tubing to protect the threads from washout. The annular step above the back pressure valve threads in the tubing hanger is a fixed-point for packoff of the mandrel and, therefore, a length of the mandrel is determined by the distance from the annular step to the top of the wellhead and a lockdown mechanism for securing the wellhead isolation tool to the wellhead preferably provides a range of adjustment to compensate for variations in the position of the top end of the mandrel when the mandrel is packed off in different wellheads.

Another example of a well tool in an operative position in which the mandrel of the well tool is packed-off against a fixed-point in the well is described in Applicant's U.S. Pat. No. 5,819,851 which issued on Oct. 13, 1998 and is entitled BLOWOUT PREVENTER PROTECTOR FOR USE DURING HIGH PRESSURE OIL/GAS WELL STIMULATION. The blowout preventer protector described in that patent includes a mandrel that is forcibly reciprocatable in an annular cavity of a spool. The mandrel is stroked down through a blowout preventer and packed off at the bottom end against a bit guide that is attached to a top end of the casing to protect the blowout preventer from exposure to fluid pressure as well as abrasive and corrosive well stimulation fluids. The bit guide attached to the top end of the casing provides a fixed-point for packoff of the mandrel.

It is apparent from the examples described above that, as a result of new tools being invented and new technology being developed, there is a need for a lockdown mechanism for securing a well tool requiring a fixed-point packoff in an operative position in the well.

The blowout preventer protector described in U.S. Pat. No. 5,819,851 includes a mandrel that is integrally incorporated with a hydraulic setting tool. The mandrel is not separable from the hydraulic setting tool and the setting tool is used to hydraulically lock the mandrel in an operative position. The mandrel. can be secured at any location within the annular cavity by maintaining the hydraulic pressure in the annular cavity after the mandrel is packed-off against the bit guide. The stroke of the hydraulic setting tool is used for inserting the mandrel through the blowout preventer, and also provides compensation for variations in a distance from the bit guide to the top of the blowout preventer when the mandrel is inserted through different wellheads. The blowout preventer protector is widely accepted in the industry and the hydraulic setting tool is very convenient for securing a mandrel of a well tool in the operative position requiring fixed-point packoff in the well. However, the setting tool must be fairly long to provide sufficient stroke. Furthermore, the setting tool is not removable from the mandrel during a well treatment to stimulate production. Consequently, the blowout preventer protector has a high profile. A well tool with a high profile is not convenient because access to equipment mounted thereto, such as a high pressure valve, is impeded by the height of the valve above ground. In addition, a hydraulic lockdown mechanism is considered less secure than a mechanical lockdown mechanism. The hydraulic lockdown mechanism is dependent on maintenance of the hydraulic fluid pressure in the setting tool. Since fluid pressure may be lost for a variety of reasons, persons in the industry are generally less inclined to endorse or accept a hydraulic lockdown mechanism.

A mechanical lockdown mechanism having a range of adjustment is used for the well tools described in Applicant's co-pending U.S. patent application filed on Jun. 23, 1999 and the application filed on Jul. 16, 1999 referenced above. The mechanical lockdown mechanism described in the above two patent applications is for securing a mandrel of well tools in an operative position requiring fixed-point packoff in the well, and provides a broad range of adjustment to compensate for variations in the height of different wellheads to which the well tool is mounted. The mechanical lockdown mechanism includes a base member that is adapted to be mounted to a top of the wellhead, the base member having a central passage to permit the insertion and the removal of the mandrel. The passage is surrounded by an integral sleeve having an elongated spiral thread for engaging a lockdown nut that is adapted to secure the mandrel in the operative position. The spiral thread on the integral sleeve and the lockdown nut have a length adequate to ensure safe operation at well stimulation fluid pressures. At least one of the spiral threads on the integral sleeve and the lockdown nut has a length adequate to provide a significant range of adjustment to compensate for variation in a distance between the top of the wellhead and the fixed-point for packoff in the well when the tool is mounted to different wellheads. The mechanical lockdown mechanism is separated from the hydraulic setting tool and, therefore, permits the setting tool to be removed from the well tool after the mandrel is locked down in the operative position. The tools therefore provide a low profile to facilitate well stimulation operations. The advantages also include the security of a mechanical lockdown mechanism. Therefore, there exists a need for a lockdown mechanism for securing a mandrel of a well tool in an operative position requiring fixed-point packoff in the well which provides a broader range of adjustment while ensuring a secure mechanical lockdown for maximum security.

SUMMARY OF THE INVENTION

It is a primary object of the invention to provide a lockdown mechanism for securing a mandrel of a well tool in an operative position in which the mandrel is packed-off against a fixed-point in the well.

It is another object of the invention to provide a lockdown mechanism for securing a mandrel of the well tool in an operative position requiring fixed-point packoff in the well, the lockdown mechanism having a low profile for easy access to a high pressure valve during use while the tool is in the operative position.

It is a further object of the invention to provide a lockdown mechanism for securing a mandrel of the well tool in an operative position requiring fixed-point packoff in the well which is convenient to use.

It is yet a further object of the invention to provide a lockdown mechanism for securing a mandrel of a well tool in an operative position requiring fixed-point packoff in the well which combines a hydraulic lockdown mechanism with a mechanical lockdown mechanism.

In accordance with one aspect of the invention, there is provided an apparatus for securing a mandrel of a well tool in an operative position requiring fixed-point packoff in the well, comprising a first and a second lockdown mechanism arranged so that the mandrel is locked in the operative position only when both the first and the second lockdown mechanisms are in respective lockdown positions; the first lockdown mechanism adapted to detachably maintain the mandrel in proximity to the fixed-point packoff when in the lockdown position, the first lockdown mechanism including a base member for connection to a wellhead of the well and a locking member for detachably engaging the base member; and the second lockdown mechanism having a range of adjustment adequate to ensure that the mandrel can be moved into the operative position and locked down in the operative position while the first lockdown mechanism is in the lockdown position.

The second lockdown mechanism preferably comprises a first member connected to the mandrel and a second member connected to the locking member of the first lockdown mechanism, the first and second members being linked to permit movement with respect to each other within the range of adjustment.

In accordance with one embodiment of the invention, the second member of the second lockdown mechanism includes at least one threaded bolt connected at a fixed end to the locking member of the first lockdown mechanism and the first member of the second lockdown mechanism has at least one bore to permit the at least one threaded bolt to pass therethrough without resistance, the at least one threaded bolt being prevented from being withdrawn from the bore by a lock nut which is adapted to be rotated from a free end of the threaded bolt towards the fixed end to lock the second lockdown mechanism in the lockdown position.

In accordance with another embodiment of the invention, the first member of the second lockdown mechanism includes a piston fixed to the mandrel and the second member of the second lockdown mechanism includes a cylinder connected with the locking member of the first lockdown mechanism, the piston being adapted to be reciprocated within the cylinder using fluid pressure.

In accordance with another aspect of the invention, there is provided an apparatus used for securing a mandrel of a well tool in an operative position in which the mandrel is packed off against a fixed-point in the well, comprising a mechanical lockdown mechanism for detachably securing the well tool to a wellhead of the well and maintaining the mandrel in proximity to the fixed-point for packoff, the mechanical lockdown mechanism including a base member for connection of the wellhead and a locking member for detachably engaging the base member; a hydraulic mechanism including a cylinder and a piston which may be reciprocated within the cylinder using fluid pressure, the cylinder being connected to the locking member of the mechanical lockdown mechanism and the piston being fixed to the mandrel of the tool so that the mandrel may be moved to and maintained in the operative position by injecting fluid pressure into the cylinder while the mechanical lockdown mechanism is in a lockdown position. The hydraulic mechanism preferably comprises a mechanical locking mechanism to ensure the mandrel is maintained in the operative position in the event that the fluid pressure is lost.

The invention provides a lockdown mechanism with a greater range of adjustment for securing a mandrel of a well tool in an operative position requiring fixed-point packoff in the well, in comparison with prior art lockdown mechanisms. Consequently, the length of a mandrel may be less precisely matched to a distance from the fixed-point for packoff to the top of the wellhead. Other features and advantages will become apparent given the preferred embodiments which are described below.

BRIEF DESCRIPTION OF THE DRAWINGS

The invention will now be further explained by way of example only and with reference to the following drawings, in which.

DETAILED DESCRIPTION OF THE PREFERRED EMBODIMENT

Figure 1:
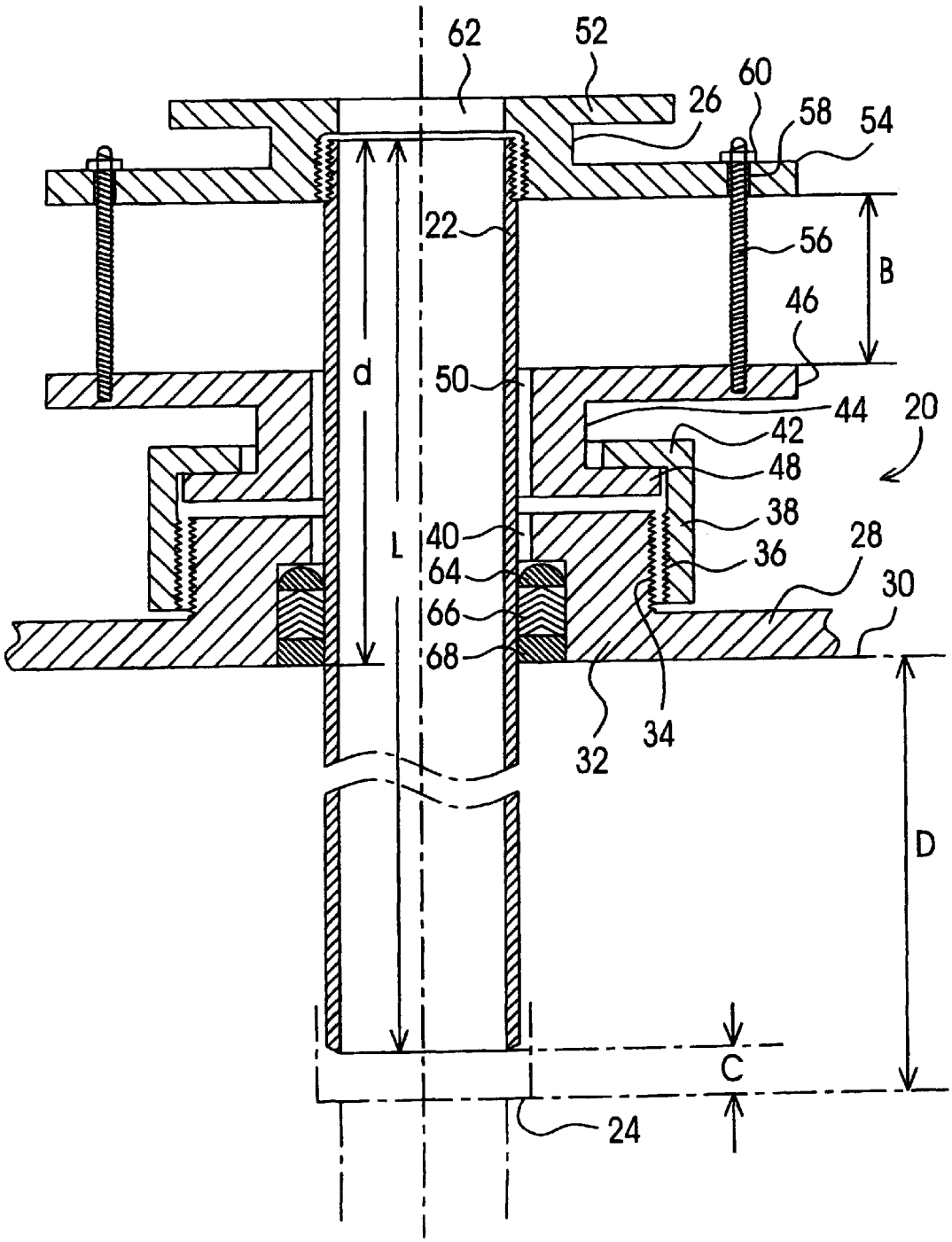
FIGS. 1 to 4 illustrate cross-sectional views of an apparatus in various working positions in accordance with a preferred embodiment of the invention.
Figure 7:
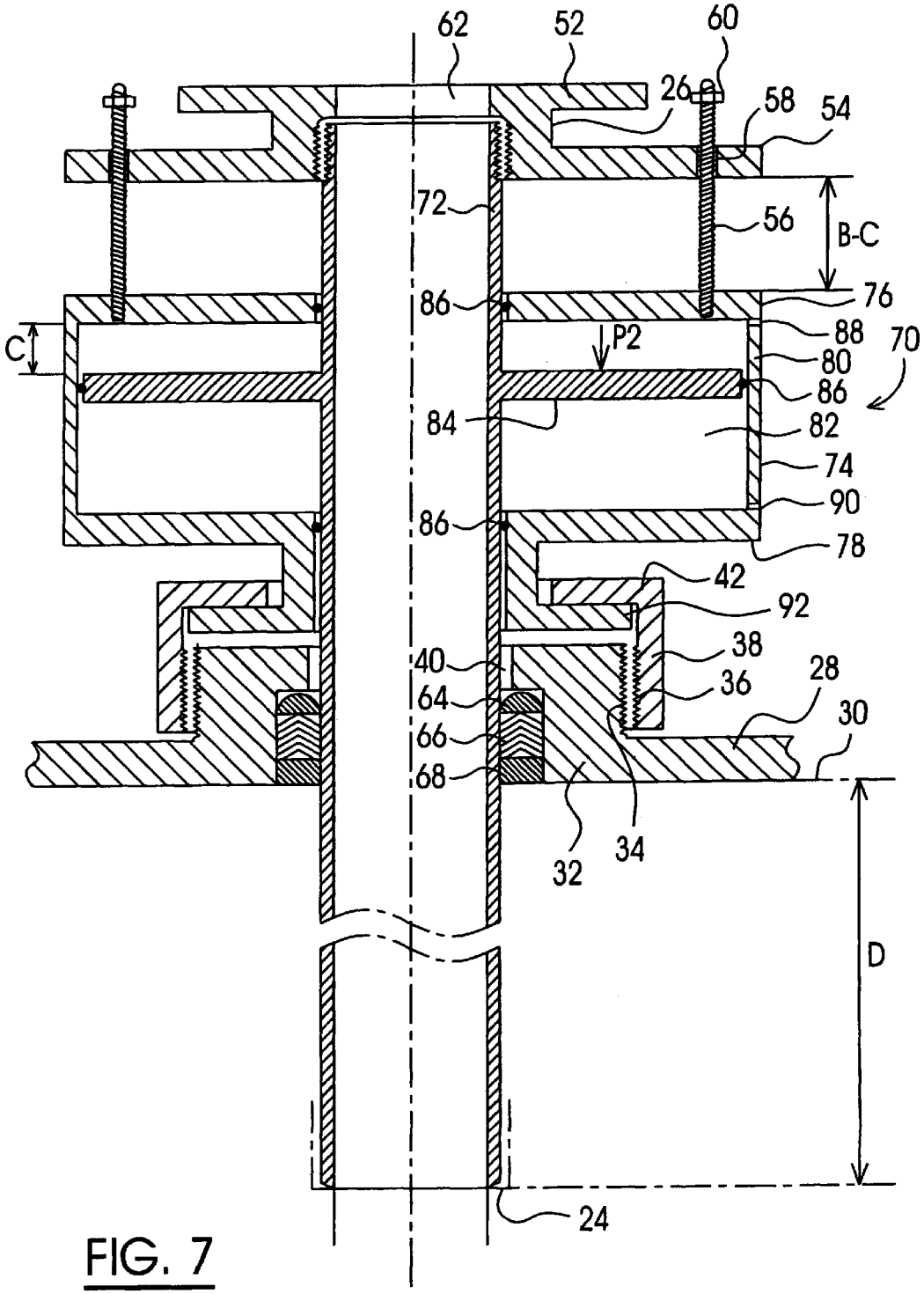
Figure 8:
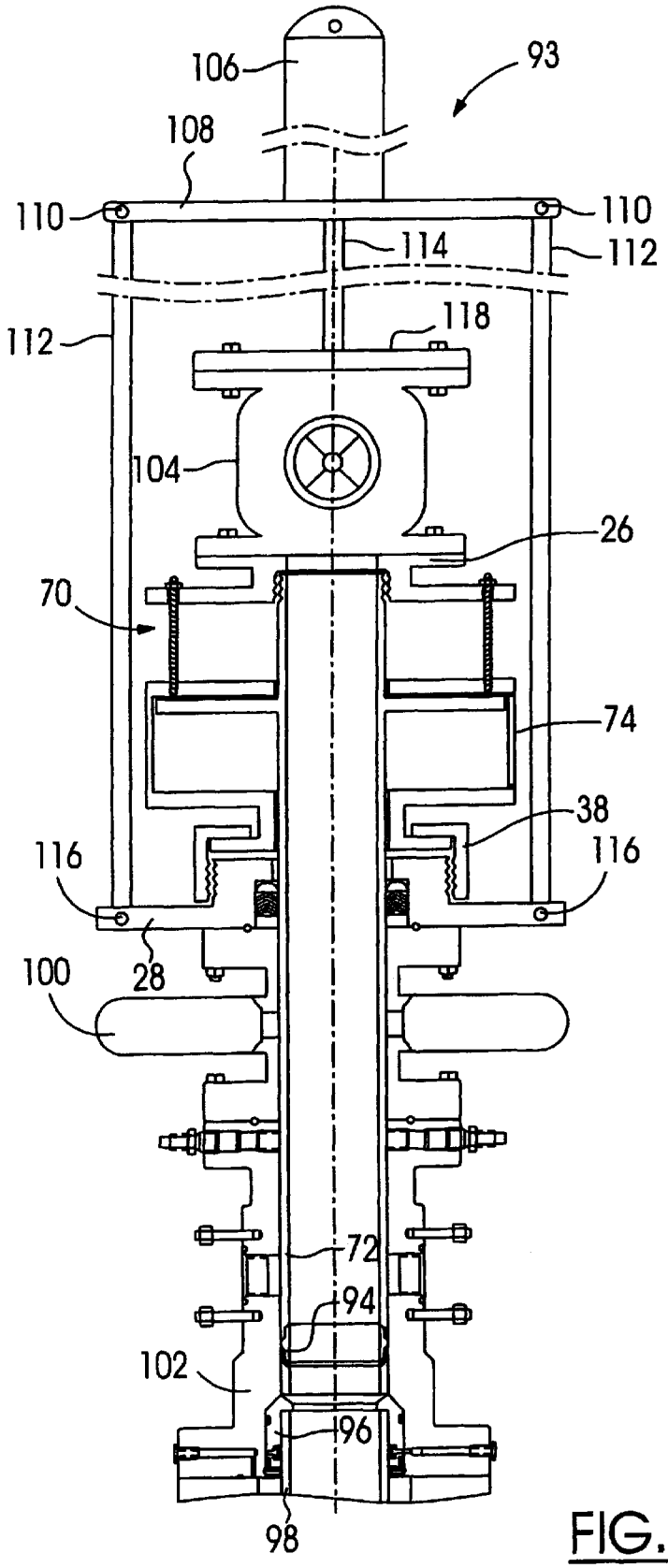
FIG. 8 is a schematic diagram of the apparatus shown in FIG. 5 mounted to a blowout preventer through which a mandrel is to be stroked and secured in an operative position in which the mandrel is packed off against a bit guide mounted to a top of a casing of the well.
Figure 9:
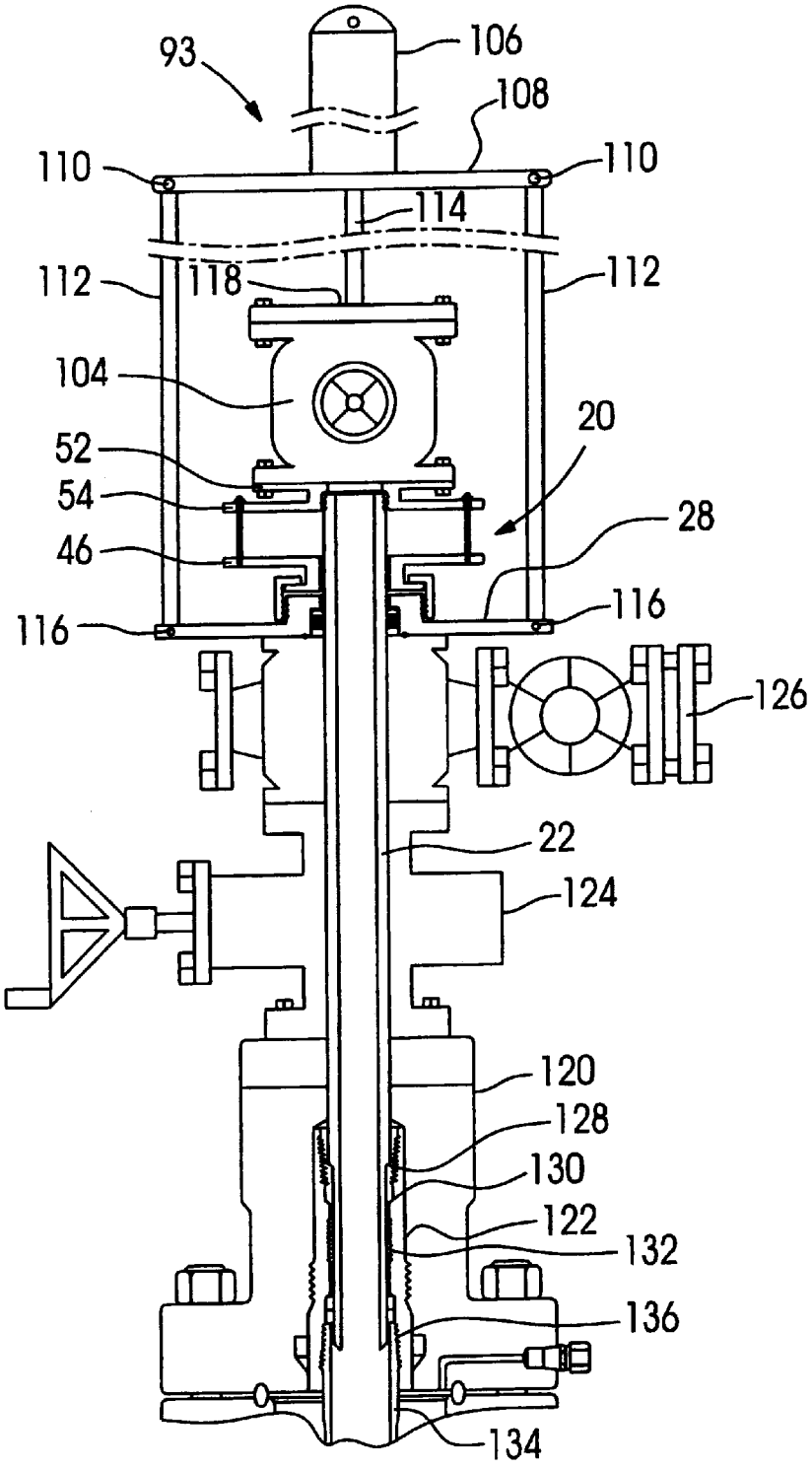
FIG. 9 is a schematic diagram of the apparatus shown in FIG. 1 mounted to a wellhead through which a mandrel is to be stroked and secured in an operative position in which the mandrel is packed off against an annular step in a tubing hanger of the wellhead.

FIG. 1 shows a cross-sectional view of a first lockdown mechanism 20 for securing a mandrel 22 of a well tool in an operative position in which the mandrel 22 is packed off against a fixed-point 24 in the well. The fixed-point for packoff may be a bit guide mounted to the top of a casing, as shown in FIG. 8, an annular step above back pressure valve threads of a tubing hanger, as shown in FIG. 9, or any other type of fixed-point location used for packoff in a wellhead, a casing, a tubing or a downhole tool. For the purpose of convenient description, the mandrel is assumed to be packed off against a fixed packoff point at the bottom of FIGS. 1 through 7.

The apparatus 20 includes a mandrel head 26 connected to a top end of the mandrel 22 and a base plate 28 mounted to a top of the wellhead, which is indicated by line 30. The mandrel head 26 is separable from the base plate 28 to permit the mandrel 22, which is connected to the mandrel head 26, to be inserted through the base plate 28 into the wellhead until the mandrel 22 reaches a fixed-point 24 for packoff. In different wellheads, a distance "D" from the fixed-point 24 for packoff to the top of the wellhead may vary. Although a length "L" of the mandrel 22 may be adjusted by the insertion of extension sections, as described in Applicant's co-pending patent applications, it is not practical to provide a large number of extension sections, each having a different length to permit mandrels to be assembled to precisely match the distance "D" of each wellhead. A distance "d" from a top of the wellhead 30 to a top end of the mandrel 22 is a constant when the mandrel 22 is locked down to the base plate 28 by a first locking member 38, as shown in FIG. 1. Consequently, a range of adjustment "B" is provided by a second locking member such that "B" is greater than a distance "C" between a bottom end of the mandrel 22 and the fixed packoff point 24 when the mandrel 22 is locked down to the base plate 28, as shown in FIG. 1.

The base plate 28 is preferably a circular disc which includes an integral concentric sleeve 32 perpendicular to the base plate 28. A spiral thread 34 on the exterior of the integral sleeve 32 mates with a complementary spiral thread 36 on an interior surface of a lockdown nut 38. The base plate 28 and the integral sleeve 32 include a central passage 40 to permit the mandrel 22 to pass through. The lockdown nut 38 includes a top wall 42 for rotatably retaining a connector 44. The connector 44 is a cylindrical body with an upper flange 46 and a lower flange 48 which engages the top wall 42 of the lockdown nut 38. A central passage 50 through the connector 44 permits the mandrel 22 to fully pass through. The mandrel head 26 is a cylindrical body with an upper flange 52 for connection of equipment, such as a high pressure valve, and a lower flange 54 which is adjustably linked to the connector 44. The adjustable link between the connector 44 and the mandrel head 26 is provided by at least two threaded bolts 56 which extends through at least two respective bores 58 in the lower flange 54. The threaded bolts 56 are connected at their fixed ends to the upper flange 46 of the connector 44. Nuts 60 at a free end of each bolt 56 prevents the bolt from being withdrawn from the flange 54. The bore 58 has an internal diameter slightly larger than an external diameter of the bolt 56 to permit the bolt 56 to pass therethrough without resistance. The threaded bolt 56 has an adequate length to permit the range "B" of movement of the mandrel head 56 relative to the connector 44.

When the lockdown nut 38 is locked to the integral sleeve 32 by the engagement of threads 34, 36 and the mandrel head 26 is moved towards or away from the connector 44 within the range "B", the mandrel can be packed off against a fixed-point for packoff. Therefore, when the mandrel 22 may be used with wellheads having different configurations and the distance D from the fixed-point 24 for packoff to the top of the wellhead indicated by line 30 varies by a distance "C" that is not greater than the range of adjustment "B", that is, $0 \leqq C \leqq B$, the apparatus 20 is adapted to be locked down in the operative position in which a bottom end of the mandrel 22 is packed off against the fixed-point 24 for packoff.

As will be understood by those skilled in the art, in order to safely restrain fluid pressure during a well treatment to stimulate production, the number of the threaded bolts 56, nuts 60 and bores 58 is generally more than two. The bolts 56 are circumferentially spaced from each other, the number of each being dictated by the fluid pressures to be restrained and the quality of materials used. The periphery of the lower flange 54 of the mandrel head 26 extends beyond the flange 52 of the mandrel head 26 so that the upper flange 52 does not interfere with the threaded bolts 56 as the mandrel head 26 is moved towards the connector 44. The mandrel head 26 has a central passage 62 in fluid communication with the mandrel 22. The passage 62 has a diameter not smaller than the internal diameter of the mandrel 22 for a full access to the mandrel. A spiral thread is provided at the lower end of the central passage 62 for connection of the threaded top end of the mandrel 22. A sealing mechanism (not shown) is provided in the threaded connection between the top end of the mandrel 22 and the mandrel head 26 to prevent well fluids from escaping to atmosphere. The central passage 40 through the base plate 28 has a recessed lower region for receiving a steel spacer 64 and packing rings 66 preferably constructed of brass, rubber and fabric. The steel spacer 64 and packing rings 66 define a passage of the same diameter as the periphery of the mandrel 22. The steel spacer 64 and the packing rings 66 are removable and may be interchanged to accommodate different sizes of mandrel 22. The steel spacer 64 and the packing rings 66 are retained in the recessed region by a retainer nut 68. The combination of the steel spacer 64, packing rings 66 and the retainer nut 68 provide a fluid seal to prevent the passage to atmosphere of well fluids between the exterior of the mandrel 22 and the interior of the wellhead when the mandrel 22 is inserted into the wellhead.

Figure 2:
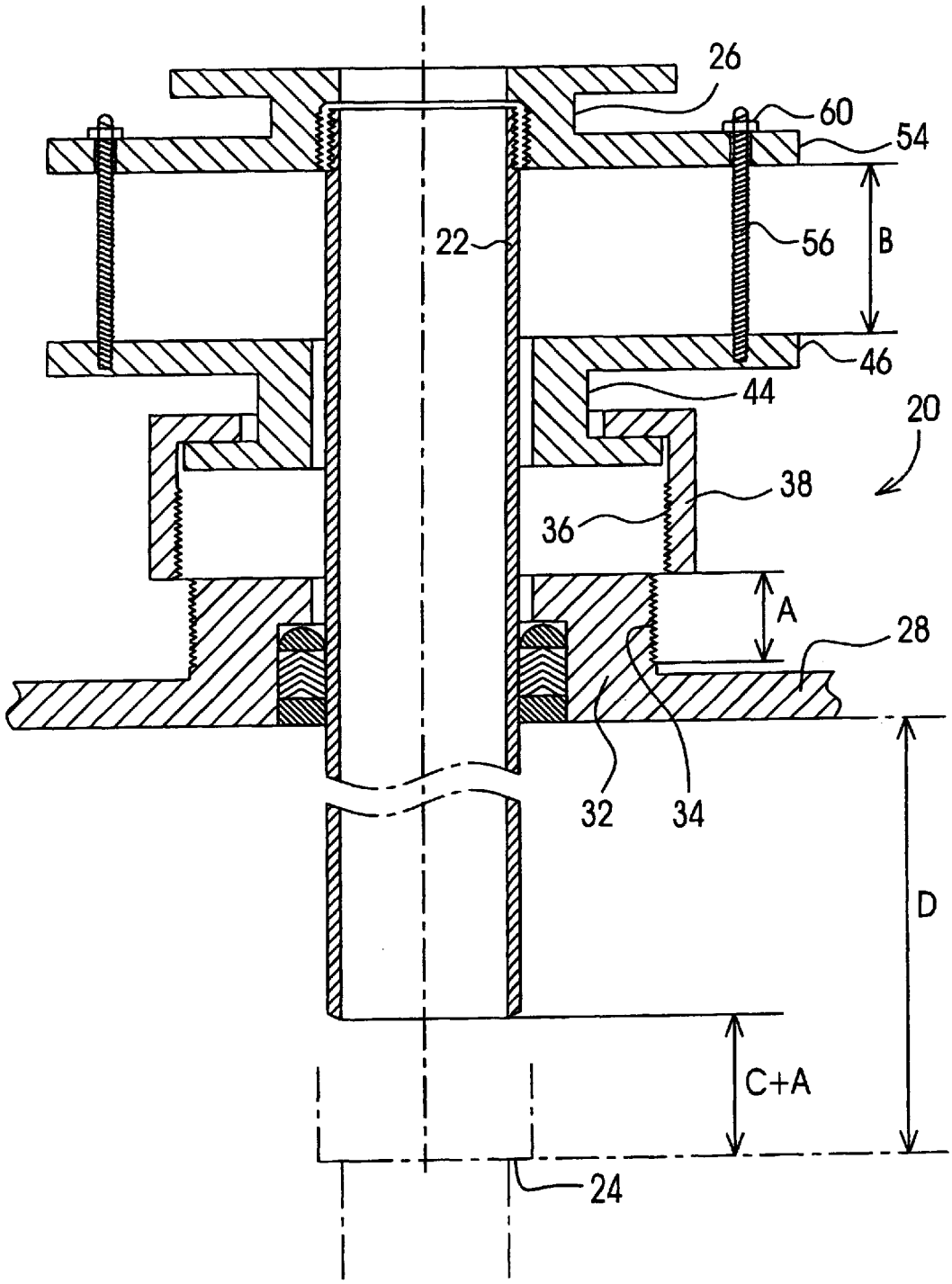
Figure 3:
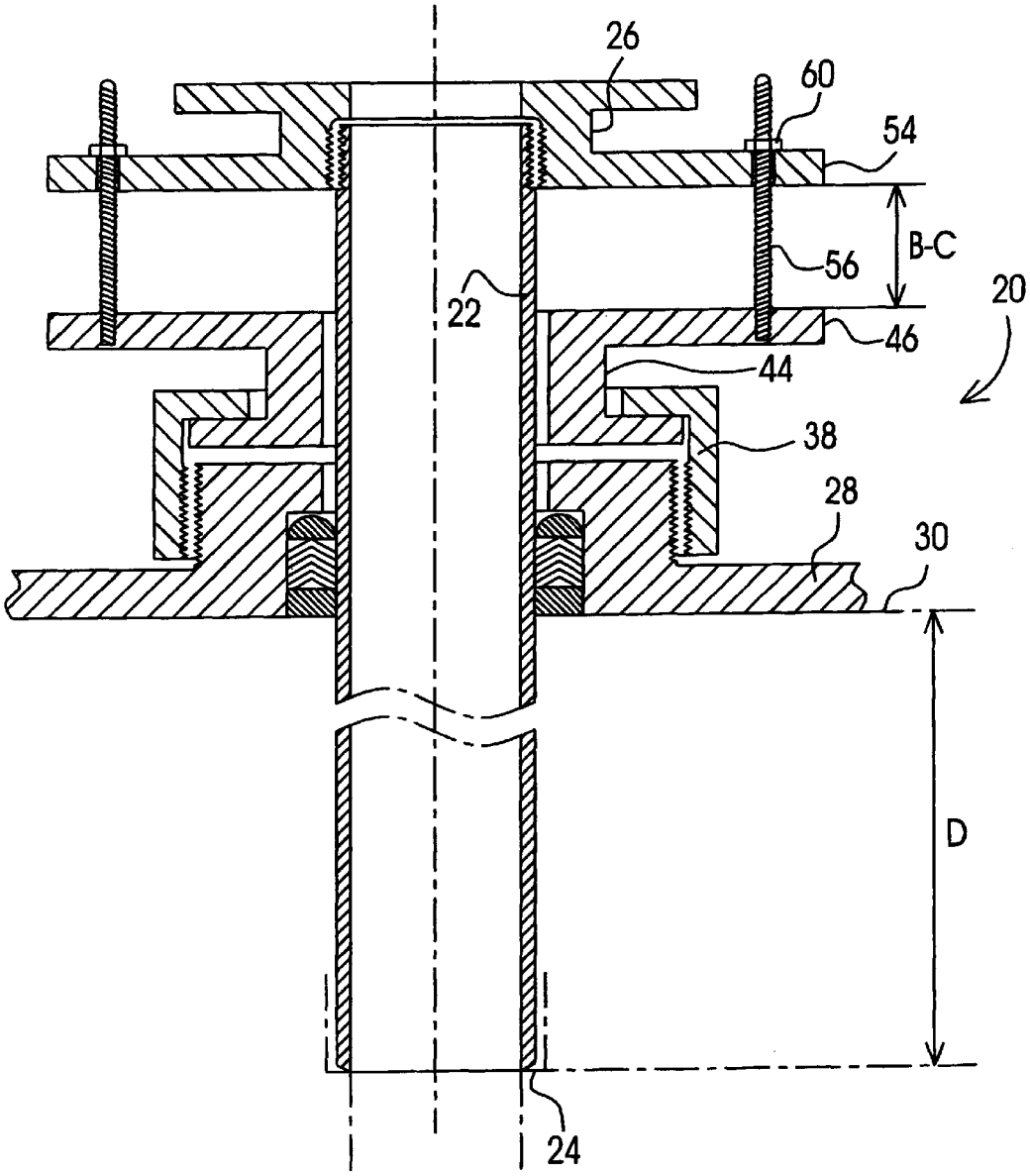

FIG. 2 shows a cross-sectional view of the apparatus 20 in a working position in which the nuts 60 are at the free end of the threaded bolts 56 and the lockdown nut 38 is disengaged from the base plate 28. In this condition, the base plate 28 can be mounted on the top of the wellhead while the other parts of the apparatus 20 are connected to the top end of mandrel 22 and are moved with the mandrel 22 when the mandrel 22 is inserted into the wellhead by a setting tool, which will be described in more detail with reference to FIGS. 8 and 9. When the apparatus 20, except for the base plate 28, is moved downwardly as the mandrel 22 is inserted through the wellhead, the upper flange 46 of the connector 44 is spaced from the lower flange 54 of the mandrel head 26, as shown in FIG. 2. For safe engagement to restrain the high fluid pressures during a well treatment to stimulate production, threads 34–36 are engaged a distance "A" by rotating the lockdown nut 38. At this stage, the bottom end of the mandrel 22 is still above the fixed-point 24 for packoff by the distance "C", as shown in FIG. 1. After the lockdown nut 38 is fully engaged as shown in FIG. 3, the mandrel 22 is further stroked down until the bottom end of the mandrel 22 packs off against the fixed-point 24. The nuts 60 are then rotated down against the lower flange 54 of the mandrel head 26 to prevent a fluid seal on the lower end of mandrel 22 (not shown) from being forced away from the fixed-point 24 for packoff after the setting tool is removed from the wellhead and pressurized fluids are injected into the well.

Figure 4:
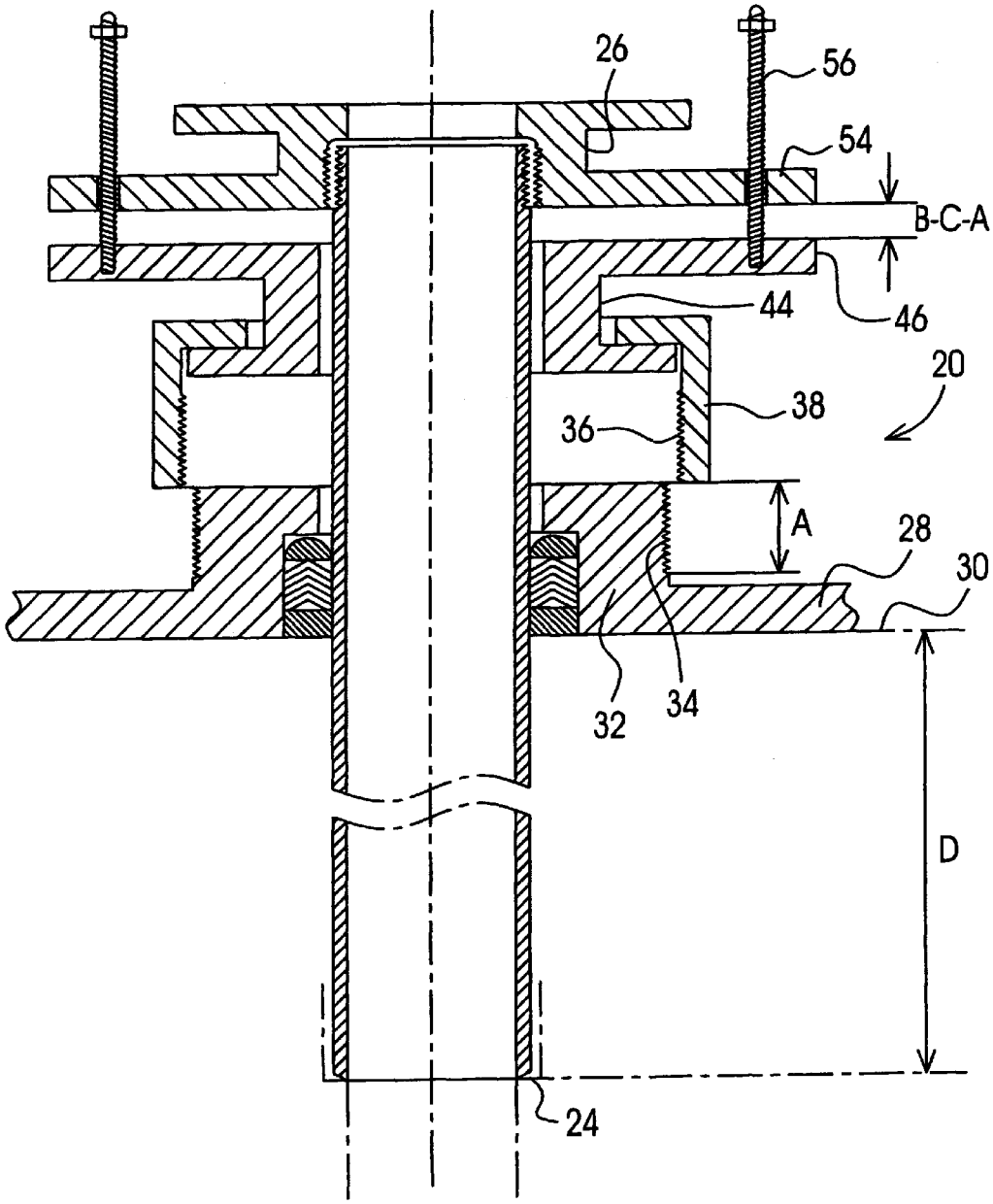

Alternatively, the mandrel 22 with connected mandrel head 26 may be stroked downwardly without engaging the lockdown nut 38 with the base plate 28 as shown in FIG. 4 until the bottom end of the mandrel 22 is packed off in an operative position against the fixed-point 24 for packoff. The lockdown nut 38 is then rotated to engage the threads 34 on the integral sleeve 32. The final locked position is the same as shown in FIG. 3. Therefore, the nuts 60 are turned down against the lower flange 54 of the mandrel head 26 to lock the apparatus 20 in the operative position.

Figure 5:
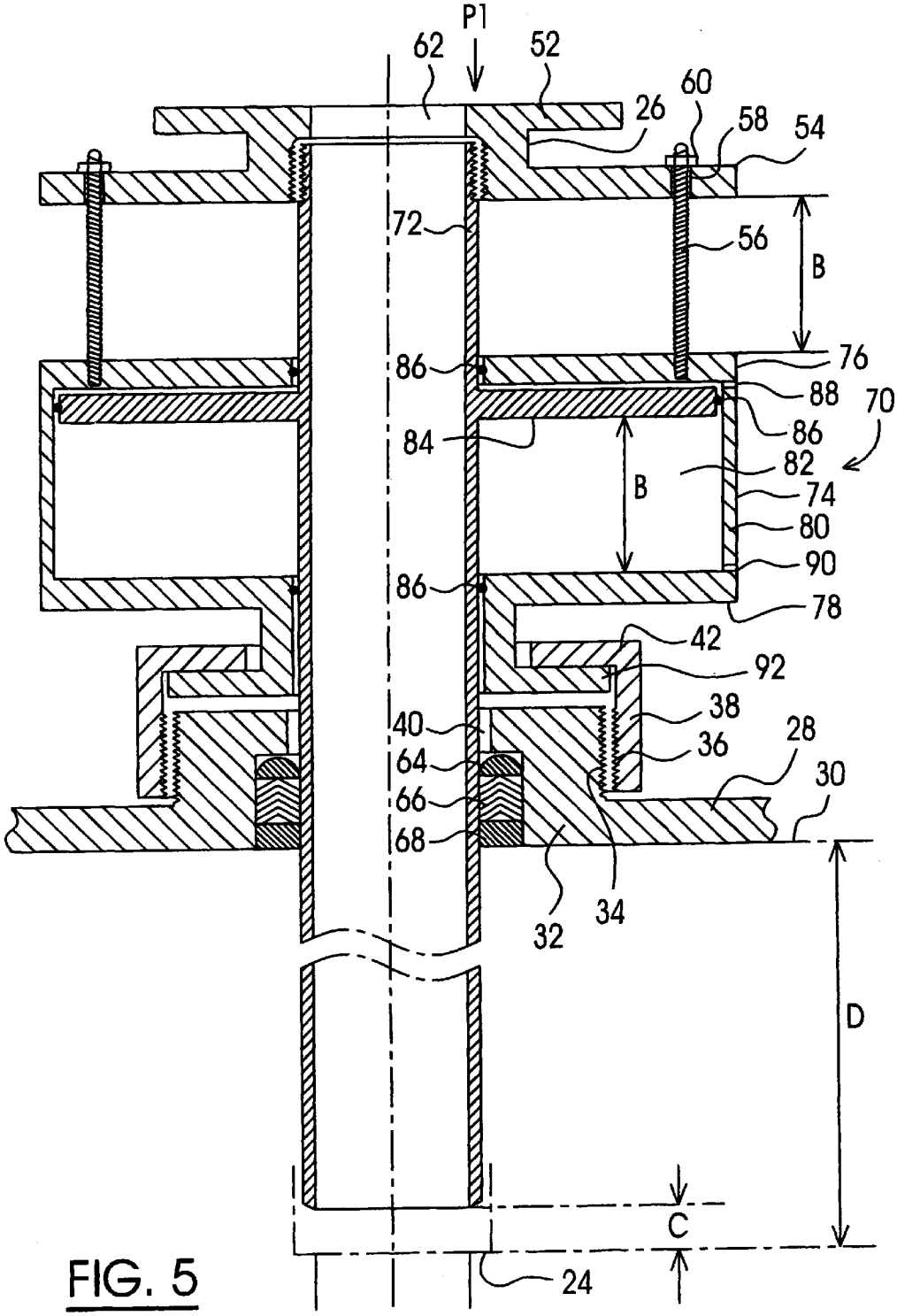
FIGS. 5 to 7 illustrate cross-sectional views of an apparatus in various working positions in accordance with another preferred embodiment of the invention.

FIG. 5 is a cross-sectional view of an apparatus 70 in accordance with another preferred embodiment of the invention. The apparatus 70 includes a mandrel head 26 threadedly connected to a top end of the mandrel 72 and a base plate 28 adapted to be mounted to the top of the wellhead, indicated by line 30. The mandrel head 26, base plate 28 and other parts indicated by reference numerals corresponding to those shown in FIG. 1 are respectively identical to the corresponding parts of the apparatus 70. The principal difference is that the apparatus 70 includes an integral hydraulic cylinder 74 in place of the connector 44 of the apparatus 20. The hydraulic cylinder 74 includes upper and lower walls 76, 78 which respectively surround the mandrel 72. The cylinder 74 further includes a sidewall 80 which defines an annular cavity 82. A piston 84 is fixed to the mandrel 72. O-ring seals 86 are provided respectively between the piston 84 and sidewall 80, upper wall 76 and the lower wall 78 and the exterior surface of a mandrel 72 to permit introduction of pressurized hydraulic fluid into the annular cavity 82 to induce movement of the piston 84. The hydraulic fluid is injected, as required, through an upper port 88 and drained through a lower port 90, and vice versa. The piston preferably has a stroke about equal to the distance "B", to match the functional length of the threaded bolts 56. The threaded bolts 56 are connected at their fixed ends to the upper wall 76. The cylinder 74 further includes a connecting flange 92 connected to but spaced from the lower wall 78 for rotatable engagement with the top wall 42 of the lockdown nut 38.

Figure 6:
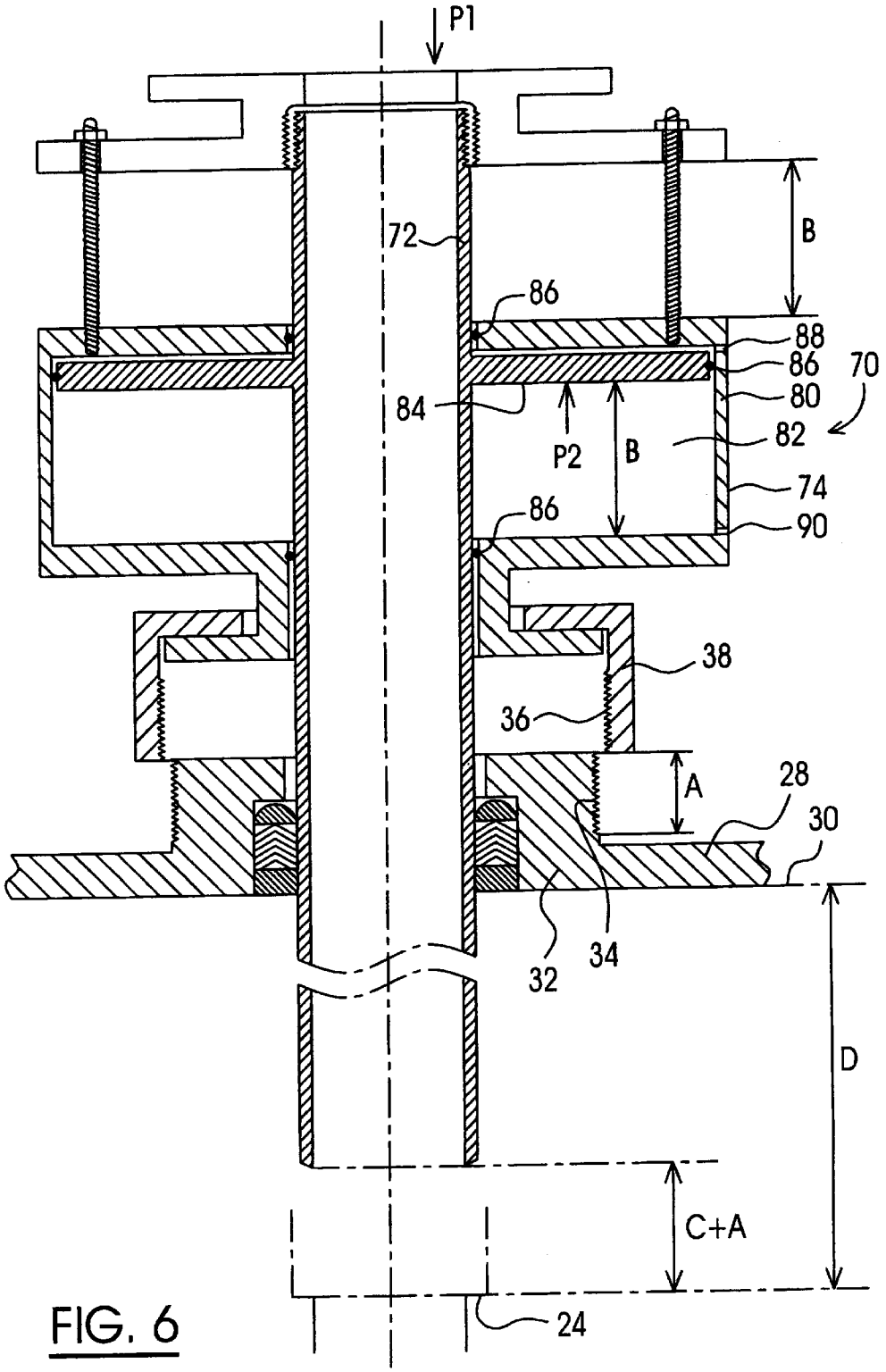

FIG. 6 is a cross-sectional view of the apparatus 70 shown in FIG. 5 with the piston 84 at the top of cylinder 74, and the lockdown nut 38 disengaged from the integral sleeve 32 of the base plate 28. As described above, the base plate 28 is mounted to the top of the wellhead before the mandrel 72 is inserted into the wellhead. The mandrel 72 is stroked down under a force P1 exerted by a setting tool, as will be described below with reference to FIGS. 8 and 9. The piston 84 is maintained at a top of the hydraulic cylinder by a force P2 exerted by pressurized hydraulic fluid trapped in the cylinder. The lockdown nut 38 is turned down to its locked position as shown in FIG. 5. The bottom end of the mandrel 70 is then a distance "C" above the fixed-point 24 for packoff.

After the lockdown nut 38 is fully engaged with the base plate 28, the setting tool is removed from the wellhead and the well tool is left unobstructed for access. Pressurized hydraulic fluid is injected into the upper port 88 of the cylinder 74 while the hydraulic fluid below the piston 84 is drained from the lower port 90 so that the mandrel 72 is forced downwardly to packoff against the fixed-point 24 under a force P2 exerted on the piston 84 by the pressurized hydraulic fluid, as shown in FIG. 7. The mandrel head 26 is thus forced downwardly over the distance "C" so that the space between the mandrel head 26 and the upper wall 76 of the cylinder 74 is reduced to B-C. The mandrel 72 is locked down in its operative position by the hydraulic force P2. To ensure that the mandrel is secured in the operative position, the nuts 60 are turned down against the lower flange 54 of the mandrel head 26.

FIG. 8 shows an example of the use of the apparatus 70 shown in FIG. 5, using a hydraulic setting tool 93 to insert the mandrel 72 to an operative position for a well treatment to stimulate production. In this example, the mandrel 72 is used to protect a blowout preventer 100 and includes a packoff assembly 94 that is packed-off against a top of a bit guide 96 mounted to a top of a casing 98, as described in Applicant's co-pending patent application filed Jun. 23, 1999. The hydraulic setting tool 93 illustrated in FIG. 8 is also described in Applicant's U.S. Pat. No. 4,867,243 which issued on Sep. 19, 1989 and is entitled WELLHEAD ISOLATION TOOL AND SETTING TOOL AND METHOD OF USING SAME, which is incorporated herein by reference. The blowout preventer 100 is connected to the well casing 98 by various spools, such as a tubing head spool 102, for example. The blowout preventer 100 and the tubing head spool 102 are wellhead equipment that is well known in the art and their construction and function do not form a part of this invention. The blowout preventer 100 and the tubing head spool 102 are, therefore, not described. The apparatus 70 is supported on a top of the blowout preventer by mounting the base plate 28 in a fluid tight relationship to the top flange of the blowout preventer 100. Mounted above the apparatus 70, is a high pressure valve 104 which is used for fluid flow control during a well treatment to stimulate production and, also used to prevent well fluids from escaping to the atmosphere from the top of the mandrel 72. The high pressure valve 104 is typically a hydraulic valve well known in the art. The hydraulic setting tool 93 includes a hydraulic cylinder 106 which is mounted to a support plate 108. The support plate 108 includes a central passage (not shown) to permit a piston rod 114 of the hydraulic cylinder 106 to pass through the support plate 108. The support 108 also includes at least two attachment points 110 for attachment of respective hydraulic cylinder support rods 112. The spaced apart attachment points 110 are preferably equally spaced from the central passage to ensure that the hydraulic cylinder 106 and the piston rod 114 align with the blowout preventer 100. The hydraulic cylinder support rods 112 are respectively attached at their lower ends to corresponding attachment points 116 on the base plate 28. As is apparent, the base plate 28 and the support plate 108 have a periphery that extends beyond the wellhead to provide enough radial offset of the cylinder support rods 112 to accommodate the high pressure valve 104, the mandrel head 26 and the cylinder 74. The support rods 112 are identical in length. The support rods 112 are attached to the respective spaced apart attachment points 110, 116 on the support plates 108 and the base plate 28 by means of threaded fasteners or pins (not illustrated). The piston rod 114 is attached to the top of the high pressure valve 104 by a connector 118 so that a force can be applied to stroke the mandrel 72 down through the wellhead.

After the mandrel 72 is stroked downwardly to an extent that the packoff assembly 94 is in proximity to the bit guide 96, and the lockdown nut 38 is turned down to its locked position, as illustrated in FIG. 8, the setting tool 93 including the hydraulic cylinder 106, support plate 108, cylinder support rods 112 and the connector 118 are removed. The packoff assembly 94 on the bottom of the mandrel 72 is then stroked further down until it is packed off against the bit guide 96 by injecting pressurized fluid into the top port 88 of the hydraulic cylinder 74, as illustrated in FIG. 7.

FIG. 9 shows an example of the use of the apparatus 20, shown in FIG. 1, using the hydraulic setting tool 93 to insert the mandrel 22 to an operative position for a well treatment to stimulate production. In this example, the wellhead is constructed in a well known manner from a series of valves and related flanges. The wellhead schematically illustrated in FIG. 9 includes a tubing spool 120 which receives and supports a tubing hanger 122. Connected by flange connections to the top of the tubing spool 120, are valves 124 and 126. The purpose of the two valves 124 and 126 is to control the flow of hydrocarbons from the well. The apparatus 20 is mounted above the wellhead, that is, atop the valve 126. The mandrel 22 is inserted through the wellhead into the operative position in which an elastomeric seal (not shown) on a sealing shoulder 128 is seated against an annular step 130 located above back pressure valve threads 132 of the tubing hanger 122 while a lower section of the mandrel 22 enters the top of the tubing 134 to protect the back pressure valve threads 132 and tubing threads 136, as described in Applicant's co-pending patent application filed Jul. 16, 1999. The annular step 130 of the tubing hanger 122 is the fixed-point 24 for packoff in the well. The distance from the annular step 130 to the top of the valve 126 may vary in different wellheads and, therefore, the apparatus 20 is used to provide a broad range of adjustment to compensate for variations to ensure that the mandrel 22 can be locked down in the operative position. After the setting tool 93 is mounted to the base plate 28 in the same way as described with reference to FIG. 8, the steps described with reference to FIGS. 1 to 4 are followed to lock the mandrel 22 in the operative position in which the elastomeric seal on the sealing shoulder 128 of the mandrel 22 is packed-off against the annular step 130.

The two examples described with reference to FIGS. 8 and 9 are for the purpose of illustration of the invention only and do not limit the applications of the invention. For example, the two embodiments described above may be used interchangeably. Likewise, other setting tool known in the art may be used in conjunction with the apparatus 20 or 70 for inserting the mandrel through the wellhead into proximity of the operative position. For example, a setting tool described by McLeod in U.S. Pat. No. 4,632,183 and entitled INSERTION DRIVE SYSTEM FOR TREE SAVERS which issued on Dec. 5, 1984, the entire specification which is incorporated herein by reference, may be used. Another type of setting tool which may also be used to insert the mandrel in proximity to the operative position is described by Bullen in U.S. Pat. No. 4,241,786, entitled WELLTREE SAVER which issued on May 2, 1979 and is also incorporated herein by reference.

It should also be understood that the apparatus described above can be used to lock down other types of tools which must be packed-off against a fixed-point in a well and is not limited to use with the mandrels described above.

Modifications and improvements to the above-described embodiments of the invention may become apparent to those skilled in the art. The foregoing description is intended to be exemplary rather than limiting. The scope of the invention is therefore intended to be limited solely by the scope of the appended claims.

What is claimed is:

1. An apparatus for securing a mandrel of a well tool in an operative position requiring fixed-point packoff in the well, comprising:

a first and a second lockdown mechanism arranged so that the mandrel is locked in the operative position only when both the first and the second lockdown mechanism are in respective lockdown positions;

the first lockdown mechanism adapted to detachably maintain the mandrel in proximity to the fixed-point packoff when in the lockdown position, the first lockdown mechanism including a base member for connection to a wellhead of the well and a locking member for detachably engaging the base member; and the second lockdown mechanism having a range of adjustment adequate to ensure that the mandrel can be moved into the operative position and locked down in the operative position while the first lockdown mechanism is in the lockdown position.

2. An apparatus as claimed in claim 1 wherein the second lockdown mechanism comprises a first member connected to the mandrel and a second member connected to the locking member of the first lockdown mechanism, the first and the second members being linked to permit movement with respect to each other within the range of adjustment.

3. An apparatus as claimed in claim 2 wherein the base member of the first lockdown mechanism includes a central passage to permit insertion of the mandrel down through the wellhead, and an elongated spiral thread for engaging a complementary spiral thread of the locking member.

4. An apparatus as claimed in claim 3 wherein the base member includes a base plate having an elongated sleeve perpendicular to the base plate, an interior of the sleeve forming the central passage and an exterior of the sleeve forming the elongated spiral thread, the base plate being adapted to be detachably mounted to a top of the wellhead of the well.

5. An apparatus as claimed in claim 2 wherein the second member of the second lockdown mechanism includes at least one threaded bolt connected at a fixed end to the locking member of the first lockdown mechanism and the first member of the second lockdown mechanism has at least one bore to permit the at least one threaded bolt to pass through without resistance, the at least one threaded bolt being prevented from being withdrawn from the bore by a lock nut which is adapted to be rotated from a free end of the threaded bolt towards the fixed end to lock the second lockdown mechanism in the lockdown position.

6. An apparatus as claimed in claim 5 wherein a length of the threaded bolt determines the range of the adjustment.

7. An apparatus as claimed in claim 6 wherein the first member of the second lockdown mechanism includes a flange having a central passage, the flange being connected in a fluid sealing relationship with a top end of the mandrel, the central passage being in fluid communication with the mandrel.

8. An apparatus as claimed in claim 2 wherein the first member of the second lockdown mechanism includes a piston fixed to the mandrel and the second member of the second lockdown mechanism includes a cylinder connected with the locking member of the first lockdown mechanism, the piston being adapted to be reciprocated within the cylinder using fluid pressure.

9. An apparatus as claimed in claim 8 wherein a maximum stroke of the piston within the cylinder determines the range of adjustment of the second lockdown mechanism.

10. An apparatus as claimed in claim 8 wherein the second lockdown mechanism comprises a mechanical locking mechanism adapted to ensure the mandrel is maintained in the operative position in the event that the fluid pressure is lost.

11. An apparatus as claimed in claim 10 wherein the mechanical locking mechanism includes at least two threaded bolts connected at a fixed end to the cylinder and at a free end to a flange connected to the mandrel, the flange having at least two bores to permit the at least two threaded bolts to pass through without resistance, the at least two threaded bolts being prevented from being withdrawn from the bore by a lock nut which is adapted to be rotated from the free ends of the threaded bolts towards the fixed ends to lock the second lockdown mechanism in the lockdown position.

12. An apparatus as claimed in claim 11 wherein a length of the threaded bolts is determined by the maximum stroke of the piston within the cylinder.

13. An apparatus as claimed in claim 12 wherein the flange of the mechanical locking mechanism includes a central passage, the flange being connected in a fluid sealing relationship with a top end of the mandrel and the central passage being in fluid communication with the mandrel.

14. An apparatus used for securing a mandrel of a well tool in an operative position in which the mandrel is packed off against a fixed-point in the well, comprising:

a mechanical lockdown mechanism for detachably securing the well tool to a wellhead of the well and maintaining the mandrel in proximity to the fixed-point for packoff, the mechanical lockdown mechanism including a base member for connection to the wellhead and a locking member for detachably engaging the base member;

a hydraulic mechanism including a cylinder and a piston which may be reciprocated within the cylinder using fluid pressure, the cylinder being connected to the locking member of the mechanical lockdown mechanism and the piston being fixed to the mandrel of the tool so that the mandrel may be moved to and maintained in the operative position by injecting fluid pressure into the cylinder while the mechanical lockdown mechanism is in a lockdown position.

15. An apparatus as claimed in claim 14 wherein a maximum stroke of the piston determines a maximum range of the proximity enabled when the mechanical lockdown mechanism is in the lockdown position.

16. An apparatus as claimed in claim 15 wherein the hydraulic mechanism comprises a mechanical locking mechanism adapted to ensure the mandrel is maintained in the operative position in the event that the fluid pressure is lost from the hydraulic cylinder.

17. An apparatus as claimed in claim 16 wherein the mechanical locking mechanism includes at least two threaded bolts connected at fixed ends to the cylinder and at free end to a flange connected to the mandrel, the flange having at least two bores to permit the at least two threaded bolts to pass through without resistance, the at least two threaded bolts being prevented from being withdrawn from the bores by lock nuts which are adapted to be rotated from the free ends of the threaded bolts towards the fixed ends to ensure the tool is locked in the lockdown position.

18. An apparatus as claimed in claim 17 wherein a length of the threaded bolt is determined by the maximum stroke of the piston.

19. An apparatus as claimed in claim 18 wherein the flange of the mechanical locking member includes a central passage, the flange being connected in a fluid sealing relationship to a top end of the mandrel and the central passage being in fluid communication with the mandrel.

20. An apparatus as claimed in claim 14 wherein the base member of the mechanical lockdown mechanism includes a central passage to permit insertion of the mandrel down through the wellhead, and an elongated spiral thread for engaging a complementary spiral thread of the locking member.

21. An apparatus as claimed in claim 20 wherein the base member includes a base plate having an elongated sleeve perpendicular to the base plate, an interior of the sleeve forming the central passage and an exterior of the sleeve forming the elongated spiral thread, the base plate being adapted to be detachably mounted to a top of the wellhead of the well.

22. A method for lockdown of a mandrel of a well tool in an operative position in which the mandrel is packed off against a fixed-point in the well, comprising steps of:

a) mounting above a wellhead of the well an apparatus for securing the mandrel of the well tool in the operative position, comprising a first and a second lockdown mechanism arranged so that the mandrel is locked in the operative position only when both the first and second lockdown mechanisms are in respective lockdown positions; the first lockdown mechanism being adapted to detachably maintain the mandrel in proximity to the fixed-point for packoff, and including a base member for connection to a top of a wellhead of the well and a locking member for detachably engaging the base member; and the second lockdown mechanism having a range of adjustment to ensure that the mandrel can be moved into the operative position and locked down in the operative position while the first lockdown mechanism is in the lockdown position;

b) after inserting the mandrel through the wellhead into proximity to the fixed-point in the well, engaging the locking member of the first lockdown mechanism with the base member so that the mandrel is only moveable within the range of adjustment;

c) moving the mandrel into the operative position if the mandrel is not yet packed off against the fixed-point; and d) locking the second lockdown mechanism in the lockdown position.

23. A method as claimed in claim 22 wherein step (d) includes a step of locking a first member of the second lockdown mechanism relative to a second member of the second lockdown mechanism, the first member being connected to the mandrel and the second member being connected to the locking member of the first lockdown mechanism, the first and second members being adapted to permit movement with respect to each other within the range of adjustment when the respective first and second members are in an unlocked condition.

24. A method as claimed in claim 22 wherein the second lockdown mechanism comprises a hydraulic cylinder connected to the locking member of the first lockdown mechanism and a piston connected to the mandrel and adapted to be reciprocatable within the hydraulic cylinder, and step (c) is completed by injecting pressurized fluid into the hydraulic cylinder to move the piston.

25. A method as claimed in claim 24 wherein step (d) further includes a step of maintaining fluid pressure in the hydraulic cylinder.

26. A method as claimed in claim 25 wherein step (d) further includes a step of locking a mechanical locking mechanism included in the second lockdown mechanism in a lockdown position to ensure the mandrel is secured in the operative position in the event that the fluid pressure is lost.

27. A method as claimed in claim 26 wherein the mechanical locking mechanism includes a flange connected to a top of the mandrel and at least two threaded bolts connected at fixed ends to the cylinder, the flange having at least two bores to permit the at least two threaded bolts to pass through without resistance, the at least two threaded bolts being prevented from being withdrawn from the bores by nuts which are adapted to be rotated from the free ends of the threaded bolts towards the fixed ends to lock the second lockdown mechanism in the lockdown position.

* * * * *